US010060331B1

(12) United States Patent
Ocasio

(10) Patent No.: US 10,060,331 B1
(45) Date of Patent: Aug. 28, 2018

(54) TEMPERATURE INDICATING CAP ASSEMBLY

(71) Applicant: William Ocasio, Huntersville, NC (US)

(72) Inventor: William Ocasio, Huntersville, NC (US)

( * ) Notice: Subject to any disclaimer, the term of this patent is extended or adjusted under 35 U.S.C. 154(b) by 0 days.

(21) Appl. No.: 15/445,195

(22) Filed: Feb. 28, 2017

(51) Int. Cl.

| | |
|---|---|
| ***G01L 1/00*** | (2006.01) |
| ***F01P 11/02*** | (2006.01) |
| ***B65D 55/10*** | (2006.01) |
| ***B65D 51/24*** | (2006.01) |
| ***F01P 11/16*** | (2006.01) |

(52) U.S. Cl.
CPC ..... *F01P 11/0247* (2013.01); *B65D 51/245* (2013.01); *B65D 55/10* (2013.01); *F01P 11/16* (2013.01)

(58) Field of Classification Search
USPC ..... 374/208, 146
See application file for complete search history.

(56) References Cited

U.S. PATENT DOCUMENTS

| | | | |
|---|---|---|---|
| 2,528,372 | A | 10/1950 | Kellogg |
| 3,373,894 | A | 3/1968 | Johnson |
| 4,872,584 | A | 10/1989 | Sakai |
| 4,927,049 | A | 5/1990 | Giordano |
| D399,177 | S | 10/1998 | Perry |
| 6,378,717 | B1 | 4/2002 | Reutter |
| 6,967,572 | B1 | 11/2005 | Oladeinde |

FOREIGN PATENT DOCUMENTS

| | | |
|---|---|---|
| WO | WO01995032904 | 12/1995 |

*Primary Examiner* — Mirellys Jagan

(57) ABSTRACT

A temperature indicating cap assembly includes a radiator cap that is removably attached to a fill neck on a radiator. A temperature indicator is coupled to the radiator cap. The temperature indicator is in thermal communication with the radiator when the radiator cap is removably coupled to the radiator. The temperature indicator indicates a safe temperature, a caution temperature and a danger temperature. In this way the temperature indicator communicates when the radiator cap may be safely removed from the radiator. A lock is coupled to the radiator cap and the lock is comprised of a thermally reactive material. Moreover, the lock engage the fill neck when the temperature of the radiator is above the caution temperature.

12 Claims, 3 Drawing Sheets

TEMPERATURE INDICATING CAP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cap devices and more particularly pertains to a new cap device for inhibiting a cap from being removed from a radiator when the radiator is hot.

BRIEF SUMMARY OF THE INVENTION

An embodiment of the disclosure meets the needs presented above by generally comprising a radiator cap that is removably attached to a fill neck on a radiator. A temperature indicator is coupled to the radiator cap. The temperature indicator is in thermal communication with the radiator when the radiator cap is removably coupled to the radiator. The temperature indicator indicates a safe temperature, a caution temperature and a danger temperature. In this way the temperature indicator communicates when the radiator cap may be safely removed from the radiator. A lock is coupled to the radiator cap and the lock is comprised of a thermally reactive material. Moreover, the lock engage the fill neck when the temperature of the radiator is above the caution temperature.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
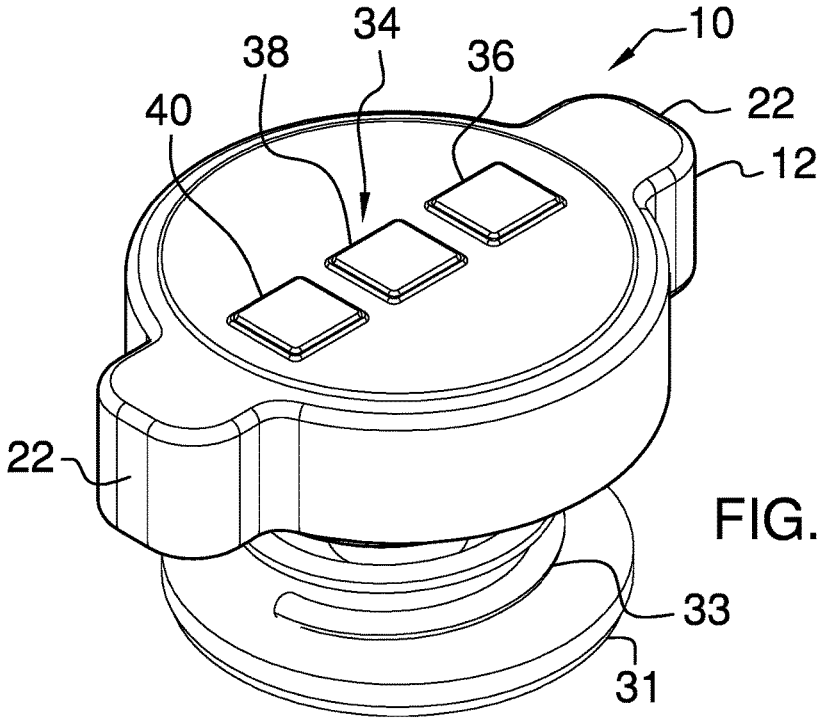
FIG. 1 is a perspective view of a temperature indicating cap assembly according to an embodiment of the disclosure.
Figure 2:
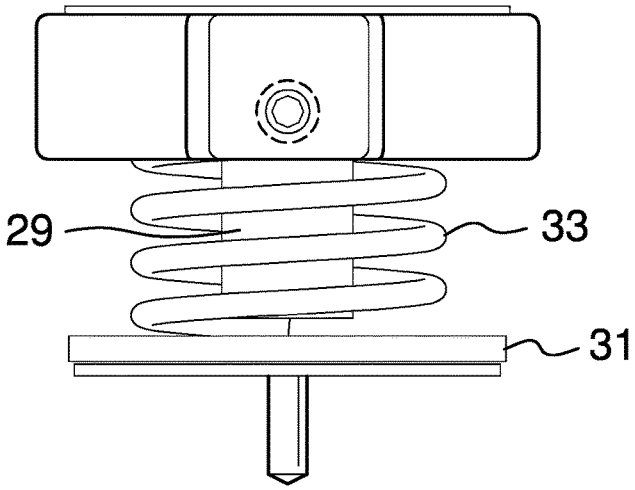
FIG. 2 is a front view of an embodiment of the disclosure.
Figure 3:
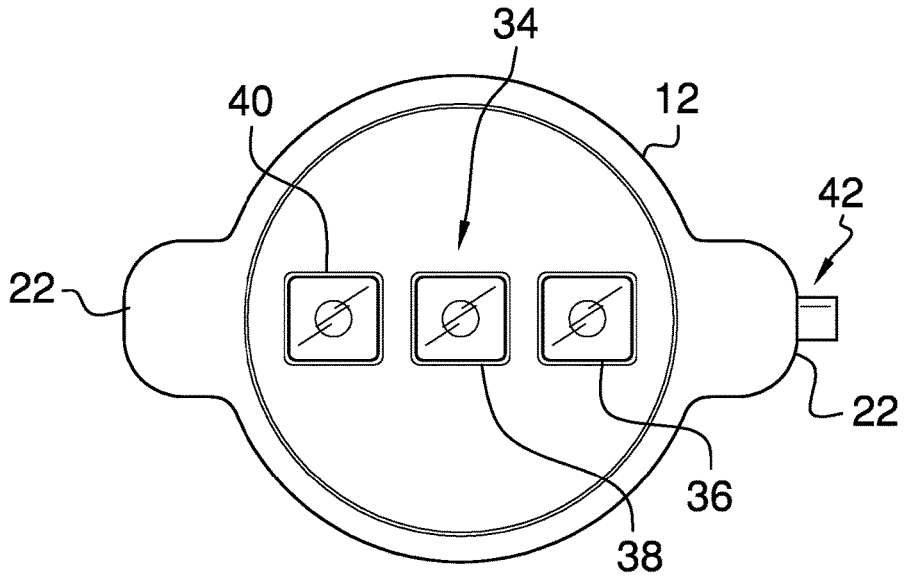
FIG. 3 is a top view of an embodiment of the disclosure.
Figure 4:
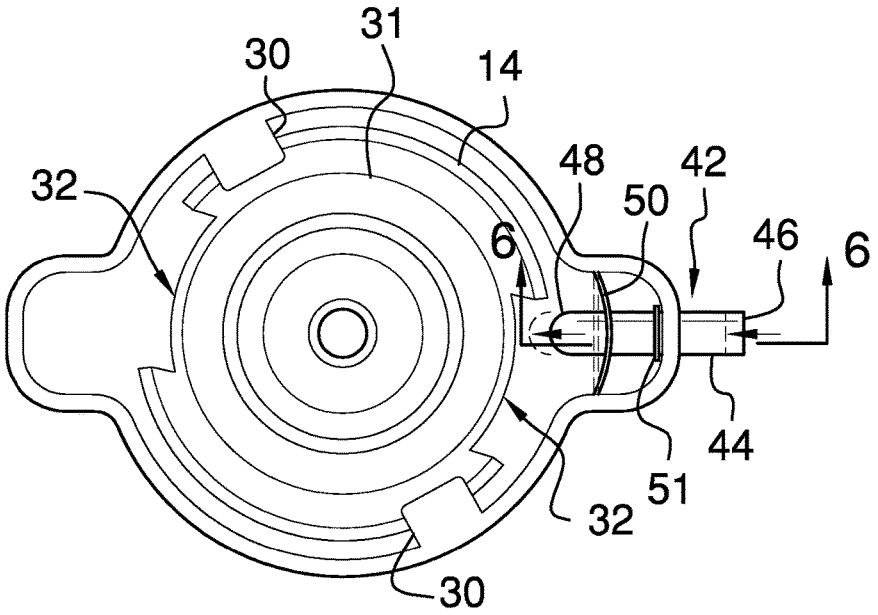
FIG. 4 is a bottom view of an embodiment of the disclosure.

With reference now to the drawings, and in particular to FIGS. 1 through 6 thereof, a new cap device embodying the principles and concepts of an embodiment of the disclosure and generally designated by the reference numeral 10 will be described.

As best illustrated in FIGS. 1 through 6, the temperature indicating cap assembly 10 generally comprises a radiator cap 12 that is selectively removably attached to a fill neck 14 on a radiator 16. The radiator 16 may be a radiator in a vehicle of any conventional design to include, but not be limited to, passenger vehicles, heavy equipment and commercial vehicles. The radiator cap 12 has a top wall 18 and a perimeter wall 20 extending downwardly therefrom. The perimeter wall 20 has a pair of protuberances 22 and each of the protuberances 22 extends outwardly from a center of the radiator cap 12. Thus, each of the protuberances 22 is selectively gripped thereby facilitating the radiator cap 12 to be manipulated. The top wall 18 has a top surface 24 and the perimeter wall 20 has an inwardly facing surface 26 and an outwardly facing surface 28.

A pair of tabs 30 is provided and each of the tabs 30 extends inwardly from the inwardly facing surface 26 of the perimeter wall 20. Each of the tabs 30 is selectively aligned with an associated one of a pair of slots 32 on the fill neck 14. In this way the radiator cap 12 is removably coupled to the fill neck 14. The radiator cap 12 is selectively rotated in a first direction to displace the tabs 30 from the slots 32 thereby facilitating the radiator cap 12 to be secured on the fill neck 14. The radiator cap 12 is selectively rotated in a second direction to align the tabs 30 with the associated slots 32 thereby facilitating the radiator cap 12 to be removed from the fill neck 14.

A stem 29 is coupled to and extends downwardly from the top wall 18 of the radiator cap 12. A disk 31 is slidably positioned around the stem 29 and a biasing member 33 is positioned between the stem 29 and the top wall 18. The disk 31 is positioned within the fill neck 14 when the radiator cap 12 is removably coupled to the radiator 16. In this way the disk 31 inhibits contents of the radiator 16 from escaping the fill neck 14 when the radiator cap 12 is coupled to the fill neck 14.

A temperature indicator 34 is provided and the temperature indicator 34 is coupled to the radiator cap 12. The temperature indicator 34 is thermal communication with the radiator 16 when the radiator cap 12 is removably coupled to the radiator 16. Moreover, the temperature indicator 34 indicates a safe temperature, a caution temperature and a danger temperature. In this way wherein the temperature indicator 34 communicates when the radiator cap 12 may be safely removed from the radiator 16.

The temperature indicator 34 comprises a first indicator 36 that is coupled to the top surface 24 of the top wall 18 thereby facilitating the first indicator 36 to be visible. The first indicator 36 is in thermal communication with the top wall 18. Moreover, the first indicator 36 is comprised of a thermally reactive material. In this way the first indicator 36 changes colors when the temperature in the radiator 16 is above a first trigger temperature. Thus, the first indicator 36 indicates the danger temperature. The first trigger temperature may be a temperature ranging between 125 degrees Fahrenheit and 135 degrees Fahrenheit. Additionally, the first indicator 36 may change to a red color at the first trigger temperature.

A second indicator 38 is coupled to the top surface 24 of the top wall 18 thereby facilitating the second indicator 38 to be visible. The second indicator 38 is in thermal communication with the top wall 18. Moreover, the second indicator 38 is comprised of a thermally reactive material. In this way the second indicator 38 changes colors when the temperature in the radiator 16 is below the first trigger temperature and above a second trigger temperature. Thus, the second indicator 38 indicates the caution temperature. The second trigger temperature may be a temperature ranging between 100 degrees Fahrenheit and 125 degrees Fahrenheit. Additionally, the second indicator 38 may change to a yellow color at the second trigger temperature.

A third indicator 40 is coupled to the top surface 24 of the top wall 18 thereby facilitating the third indicator 40 to be visible. The third indicator 40 is in thermal communication with the top wall 18. Moreover, the third indicator 40 is comprised of a thermally reactive material. In this way the third indicator 40 changes colors when the temperature in the radiator 16 is below the second trigger temperature. Thus, the third indicator 40 indicates the safe temperature and the third indicator 40 may change to a green color below the second trigger temperature.

A lock 42 is provided and the lock 42 is movably coupled to the radiator cap 12. The lock 42 is comprised of a thermally reactive material. Moreover, the lock 42 engages the fill neck 14 when the temperature of the radiator 16 is above the caution temperature. In this way the lock 42 inhibits the radiator cap 12 from being removed from the radiator 16 when the temperature is above the caution temperature.

The lock 42 comprises a pin 44 that has a first end 46 and a second end 48. The pin 44 slidably extends through an associated one of the protuberances 22 on the perimeter wall 20. The first end 46 is spaced from the outwardly facing surface 28 of the perimeter wall 20 and the second end 48 is spaced from the inwardly facing surface 26 of the perimeter wall 20. The pin 44 is selectively urged into a locking position to engage an associated one of the slots 32. In this way the radiator cap 12 from is inhibited from being rotated in the first direction. The pin 44 is selectively urged into a releasing position to displace the second end 48 from the associated slot. In this way the radiator cap 12 may be rotated in the second direction.

A strip 50 provided and the strip 50 is coupled to the pin 44. The strip 50 extends across and engages associated protuberance 22 with respect to the pin 44. Moreover, the strip 50 is coupled to the inwardly facing surface 26 corresponding to the associated protuberance. The strip 50 is in thermal communication with the radiator cap 12. A stop 51 is provided and the stop 51 is positioned around the pin 44. The stop 51 is positioned between the strip 50 and the first end 46 of the pin 44. Moreover, the stop 51 engages the inwardly facing surface 26 of the perimeter wall 20 to inhibit the pin 44 from being removed from the radiator cap 12.

Figure 5:
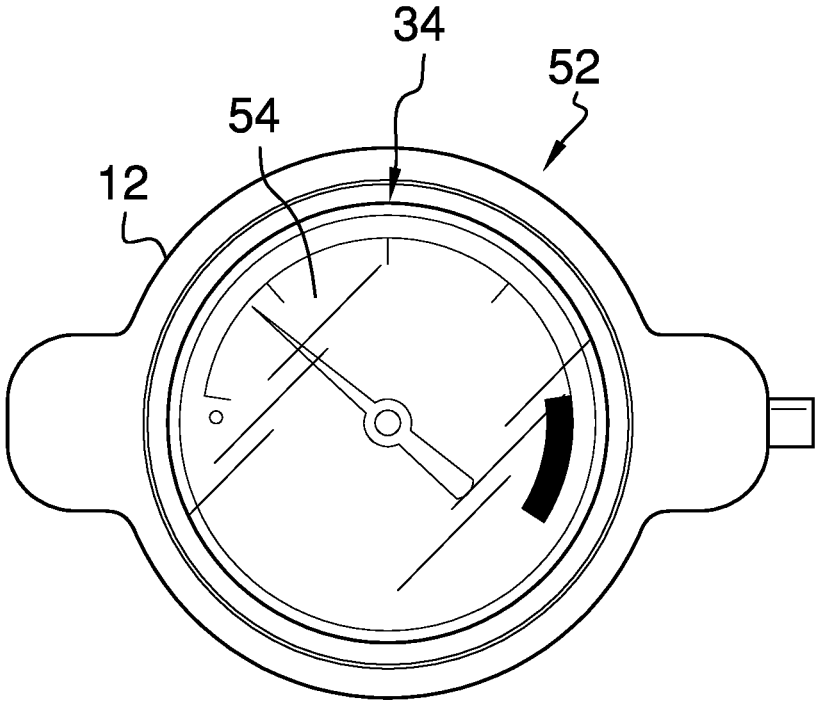
FIG. 5 is a perspective view of an alternative embodiment of the disclosure.
Figure 6:
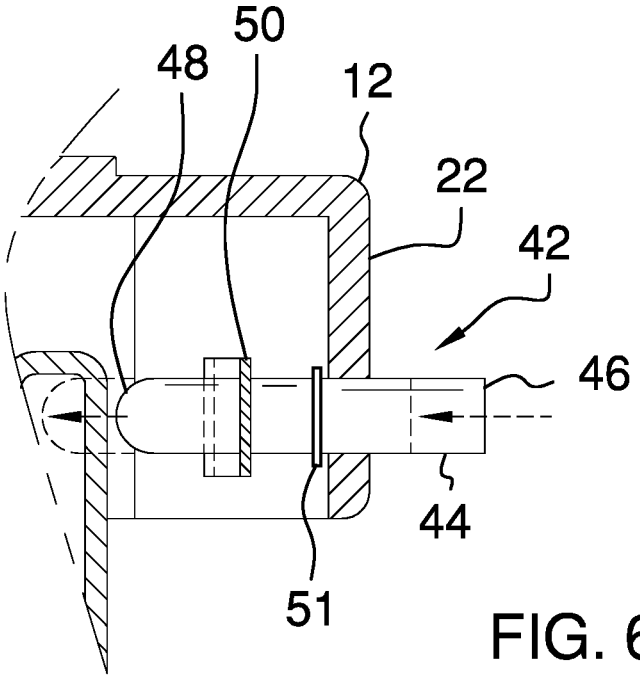
FIG. 6 is a cross sectional view taken along line 6-6 of FIG. 4 of an embodiment of the disclosure.

The strip 50 is comprised of a pair of metals that each has dissimilar thermal expansion coefficients. In this way the strip 50 bends when the temperature in the radiator 16 is above the first trigger temperature. The strip 50 is flattened when the temperature in the radiator 16 is below the first trigger temperature. Moreover, the strip 50 urges the pin 44 into the locking position when the strip 50 is bent. The strip 50 urges the pin 44 into the releasing position when the strip 50 is flattened. The strip 50 may be comprised of steel and copper. In an alternative embodiment 52 as shown in FIG. 5, the temperature indicator 34 may comprise a temperature gauge 54.

In use, the radiator cap 12 is removably coupled to the fill neck 14 on the radiator 16 and the vehicle is driven. The first indicator 36 changes color when the temperature of the radiator 16 exceeds the first trigger temperature to indicate a burn danger if the radiator cap 12 is removed. Moreover, the strip 50 bends to urge the pin 44 into the locking position when the temperature of the radiator 16 exceeds the first trigger temperature. In this way the radiator cap 12 is inhibited from being removed from the radiator 16 thereby reducing the risk of second and third degree burns.

The second indicator 38 changes color when the temperature of the radiator 16 is between the first trigger temperature and the second trigger temperature. In this way the second indicator 38 indicates that caution should be exercised when removing the radiator cap 12. Additionally, the strip 50 flattens to urge the pin 44 into the releasing position when the temperature in the radiator 16 is between the first trigger temperature and the second trigger temperature. The third indicator 40 changes color when the temperature in the radiator 16 is below the second trigger temperature. In this way the third indicator 40 indicates that the radiator cap 12 may be removed without the risk of second and third degree burns.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A temperature indicating cap assembly being configured to be removably coupled to a radiator in a vehicle thereby facilitating said assembly to indicate when a temperature of the radiator has reached a safe level, said assembly comprising:

a radiator cap being configured to be removably attached to a fill neck on a radiator;

a temperature indicator being coupled to said radiator cap wherein said temperature indicator is configured to be in thermal communication with the radiator when said radiator cap is removably coupled to the radiator, said temperature indicator indicating a safe temperature, a caution temperature and a danger temperature wherein said temperature indicator is configured to communicate when said radiator cap may be safely removed from the radiator; and a lock being coupled to said radiator cap, said lock being comprised of a thermally reactive material wherein said lock is configured to engage the fill neck when the temperature of the radiator is above the caution temperature; and said radiator cap having a top wall and a perimeter wall extending downwardly therefrom, said perimeter wall having a pair of protuberances, each of said protuberances extending outwardly from a center of said radiator cap wherein each of said protuberances is configured to be gripped thereby facilitating said radiator cap to be manipulated, said top wall having a top surface, said perimeter wall having an inwardly facing surface and an outwardly facing surface.

2. The assembly according to claim 1, further comprising a pair of tabs, each of said tabs extending inwardly from said inwardly facing surface of said perimeter wall, each of said tabs being configured to be aligned with an associated one of a pair of slots on the fill neck thereby facilitating said radiator cap to be removably coupled to the fill neck.

3. The assembly according to claim 2, wherein said radiator cap is selectively rotated in a first direction wherein each of said tabs is configured to be displaced with respect to the slots thereby facilitating said radiator cap to be secured on the fill neck, said radiator cap being selectively rotated in a second direction wherein each of said tabs is configured to be aligned with the associated slots thereby facilitating said radiator cap to be removed from the fill neck.

4. The assembly according to claim 1, wherein said temperature indicator comprises a first indicator being coupled to said top surface of said top wall wherein said first indicator is configured to be visible, said first indicator being in thermal communication with said top wall.

5. The assembly according to claim 4, wherein said first indicator is comprised of a thermally reactive material wherein said first indicator is configured to change colors when the temperature in the radiator is above a first trigger temperature thereby facilitating said first indicator to indicate the danger temperature.

6. The assembly according to claim 1, further comprising a second indicator being coupled to said top surface of said top wall wherein said second indicator is configured to be visible, said second indicator being in thermal communication with said top wall.

7. The assembly according to claim 6, wherein said second indicator is comprised of a thermally reactive material wherein said second indicator is configured to change colors when the temperature in the radiator is below the first trigger temperature and above a second trigger temperature thereby facilitating said second indicator to indicate the caution temperature.

8. The assembly according to claim 1, wherein said lock comprises a pin having a first end and a second end, said pin slidably extending through an associated one of said protuberances on said perimeter wall having said first end being spaced from said outwardly facing surface of said perimeter wall and having said second end being spaced from said inwardly facing surface of said perimeter wall.

9. The assembly according to claim 8, wherein said pin is selectively urged into a locking position wherein said second end is configured to engage an associated one of the slots thereby inhibiting said radiator cap from being removed from the fill neck, said pin being selectively urged into a releasing position wherein said second end is configured to be displaced from the associated slot thereby facilitating said radiator cap to be removed from the fill neck.

10. The assembly according to claim 9, further comprising a strip being coupled to said pin, said strip extending across and engaging said associated protuberance with respect to said pin, said strip being in thermal communication with said radiator cap.

11. The assembly according to claim 10, wherein said strip is comprised of a pair of metals each having dissimilar thermal expansion coefficients wherein said strip is configured to bend when the temperature in the radiator is above the first trigger temperature, said strip being configured to be flattened when the temperature in the radiator is below the first trigger temperature, said strip urging said pin into said locking position when said strip is bent, said strip urging said pin in to said releasing position when said strip is flattened.

12. A temperature indicating cap assembly being configured to be removably coupled to a radiator in a vehicle thereby facilitating said assembly to indicate when a temperature of the radiator has reached a safe level, said assembly comprising:

a radiator cap being configured to be removably attached to a fill neck on a radiator, said radiator cap having a top wall and a perimeter wall extending downwardly therefrom, said perimeter wall having a pair of protuberances, each of said protuberances extending outwardly from a center of said radiator cap wherein each of said protuberances is configured to be gripped thereby facilitating said radiator cap to be manipulated, said top wall having a top surface, said perimeter wall having an inwardly facing surface and an outwardly facing surface;

a pair of tabs, each of said tabs extending inwardly from said inwardly facing surface of said perimeter wall, each of said tabs being configured to be aligned with an associated one of a pair of slots on the fill neck thereby facilitating said radiator cap to be removably coupled to the fill neck, said radiator cap being selectively rotated in a first direction wherein each of said tabs is configured to be displaced with respect to the slots thereby facilitating said radiator cap to be secured on the fill neck, said radiator cap being selectively rotated in a second direction wherein each of said tabs is configured to be aligned with the associated slots thereby facilitating said radiator cap to be removed from the fill neck;

a temperature indicator being coupled to said radiator cap wherein said temperature indicator is configured to be in thermal communication with the radiator when said radiator cap is removably coupled to the radiator, said temperature indicator indicating a safe temperature, a caution temperature and a danger temperature wherein said temperature indicator is configured to communicate when said radiator cap may be safely removed from the radiator, said temperature indicator comprising:

a first indicator being coupled to said top surface of said top wall wherein said first indicator is configured to be visible, said first indicator being in thermal communication with said top wall, said first indicator being comprised of a thermally reactive material wherein said first indicator is configured to change colors when the temperature in the radiator is above a first trigger temperature thereby facilitating said first indicator to indicate the danger temperature, a second indicator being coupled to said top surface of said top wall wherein said second indicator is configured to be visible, said second indicator being in thermal communication with said top wall, said second indicator being comprised of a thermally reactive material wherein said second indicator is configured to change colors when the temperature in the radiator is below the first trigger temperature and above a second trigger temperature thereby facilitating said second indicator to indicate the caution temperature, and a third indicator being coupled to said top surface of said top wall wherein said third indicator is configured to be visible, said third indicator being in thermal communication with said top wall, said third indicator being comprised of a thermally reactive material wherein said third indicator is configured to change colors when the temperature in the radiator is below the second trigger temperature thereby facilitating said third indicator to indicate the safe temperature; and a lock being coupled to said radiator cap, said lock being comprised of a thermally reactive material wherein said lock is configured to engage the fill neck when the temperature of the radiator is above the caution temperature, said lock comprising:

a pin having a first end and a second end, said pin slidably extending through an associated one of said protuberances on said perimeter wall having said first end being spaced from said outwardly facing surface of said perimeter wall and having said second end being spaced from said inwardly facing surface of said perimeter wall, said pin being selectively urged into a locking position wherein said second end is configured to engage an associated one of the slots thereby inhibiting said radiator cap from being removed from the fill neck, said pin being selectively urged into a releasing position wherein said second end is configured to be displaced from the associated slot thereby facilitating said radiator cap to be removed from the fill neck, and a strip being coupled to said pin, said strip extending across and engaging said associated protuberance with respect to said pin, said strip being in thermal communication with said radiator cap, said strip being comprised of a pair of metals each having dissimilar thermal expansion coefficients wherein said strip is configured to bend when the temperature in the radiator is above the first trigger temperature, said strip being configured to be flattened when the temperature in the radiator is below the first trigger temperature, said strip urging said pin into said locking position when said strip is bent, said strip urging said pin in to said releasing position when said strip is flattened.

* * * * *